US008257626B2

(12) United States Patent
Kühl

(10) Patent No.: US 8,257,626 B2
(45) Date of Patent: Sep. 4, 2012

(54) FELT BODY MANUFACTURING METHOD

(75) Inventor: Thomas Kühl, Inzigkofen (DE)

(73) Assignee: Groz-Beckert KG, Albstadt (DE)

( * ) Notice: Subject to any disclaimer, the term of this patent is extended or adjusted under 35 U.S.C. 154(b) by 112 days.

(21) Appl. No.: 12/876,433

(22) Filed: Sep. 7, 2010

(65) Prior Publication Data

US 2011/0062626 A1 Mar. 17, 2011

(30) Foreign Application Priority Data

Sep. 15, 2009 (EP) ..... 09011760

(51) Int. Cl.
*B27N 5/00* (2006.01)
*A41C 3/00* (2006.01)

(52) U.S. Cl. ..... 264/113; 264/517; 264/518; 264/121; 425/80.1; 425/81.1; 425/83.1; 450/39; 450/40

(58) Field of Classification Search ..... None
See application file for complete search history.

(56) References Cited

U.S. PATENT DOCUMENTS

| | | | | |
|---|---|---|---|---|
| 2,357,392 | A * | 9/1944 | Francis, Jr | 264/6 |
| 2,609,539 | A * | 9/1952 | Shearer | 450/40 |
| 2,702,261 | A * | 2/1955 | Bacon et al. | 428/359 |
| 3,825,379 | A | 7/1974 | Lohkamp et al. | |
| 4,228,123 | A * | 10/1980 | Marshall | 264/557 |
| 4,714,647 | A | 12/1987 | Shipp et al. | |
| 6,230,776 | B1 * | 5/2001 | Choi | 156/441 |
| 2003/0116878 | A1 | 6/2003 | Takagaki | |
| 2008/0113054 | A1 * | 5/2008 | Fegelman et al. | 425/81.1 |

FOREIGN PATENT DOCUMENTS

| | | |
|---|---|---|
| DE | 19956368 | 6/2001 |
| DE | 102004030393 | 1/2006 |
| EP | 1323857 | 7/2007 |
| JP | 49100374 | 9/1974 |
| WO | 0029656 | 5/2000 |
| WO | 0153587 | 7/2001 |

* cited by examiner

*Primary Examiner* — Mary F Theisen
(74) *Attorney, Agent, or Firm* — Fitch, Even, Tabin & Flannery, LLP

(57) ABSTRACT

A method for the manufacture of spatial objects of a fleece or felt, wherein the fibers are deposited on a mold that is preferably air-permeable. The fibers may be attracted to the mold by a vacuum applied to the underside of said mold. Preferably, the mold has several spatial structures that define the shape of the fiber web that is being formed and that correspond at least approximately to the desired final shape. By subsequent compacting of the thusly obtained fiber web, a spatially three-dimensional felt object is obtained. In this method, subsequent deforming steps are unnecessary or reduced to a minimum, so that the material to be produced does not experience any substantial distortion.

10 Claims, 3 Drawing Sheets

FELT BODY MANUFACTURING METHOD

CROSS-REFERENCE TO RELATED APPLICATION

The present application claims the priority of European Patent Application No. 09 011 760.7, filed Sep. 15, 2009, the subject matter of which, in its entirety, is incorporated herein by reference.

BACKGROUND OF THE INVENTION

The invention relates to a method for the manufacture of spatial objects of felt or felt-like materials, as well as to a device for the manufacture of such products.

A device and a method for the manufacture of a felt web have been known from U.S. Pat. No. 4,714,647. In this case, a porous belt circulating around two rollers is provided, whereby several spinning beams are provided above said belt. These spinning beams dispense molten plastic material in the form of fibers. Due to a vacuum, this plastic material is then deposited on the porous belt that is advanced below the nozzle bars. The resultant fiber layer is pulled off in the form of a fiber web. A planar structure is formed.

A similar method for the manufacture of melt-blown fleece materials has been known from DE 199 56 368 A1 and from U.S. Pat. No. 3,825,379, said publications also providing information regarding the construction of appropriate melt-blowing heads. The stream of fibers produced by the melt-blowing heads is directed at a collector drum and is taken off said drum in the form of a web. A planar fleece is formed. A method for the manufacture of slubbed fleece materials has been known from DE 10 2004 030 393 A1. In this case, a fleece web is deposited on a perforated drum with a hole structure. As a result of the existing holes, the desired slubs are formed on the fleece material by means of water jets in the course of the compacting process.

Furthermore, WO 01/53587 A1 describes the manufacture of spatially shaped fleece materials by reshaping an initially planar fleece in an appropriate shaping device.

It is the object of the invention to disclose a cost-effective method for the manufacture of three-dimensionally shaped objects of non-ordered fibers, in particular for brassiere cups.

Furthermore, it is the object of the invention to disclose a device that is suitable for a suitable implementation of said method.

SUMMARY OF THE INVENTION

The above objects generally are achieved according to a first aspect of the invention with the method in accordance with the invention and according to a second aspect of the invention by a device in accordance with the invention.

In the method in accordance with the invention a support is disposed to receive a fiber web or fiber fleece, said support having a shape corresponding to the object to be manufactured. The fibers are deposited on this support in a non-ordered manner. The resultant body is still not very compacted, or not compacted at all, and can be compacted by means of suitable measures in order to form a fleece or felt body. Consequently, imparting the three-dimensional shape does not require any additional cycle of operation. The three-dimensional shape is already formed at the time when the fibers are deposited, said fibers being extruded, for example. The "three-dimensional shape" is curved in at least two different directions. To do so, the support may comprise appropriate convex and concave molds. In the case of the manufacture of brassieres, the support has the interior shape or the exterior shape of the later desired cup.

The support may have a porous or sieve-like structure. Due to a pressure difference on the support, the fibers can be deposited on said support in a targeted manner. In order to generate the pressure difference, a vacuum under the support may be utilized. Also, an excess pressure existing at the time of extrusion of the fibers can facilitate the deposition of fibers on the support. By pulling off the resultant web having the corresponding shapes in one direction, a fabric already having the three-dimensional shapes with the desired cups or other shapes is being produced. The fabric can then be compacted by additional processing steps, for example, by thermobonding, proofing, water jet compacting or the like.

Preferably, a first compacting of the fiber web may already take place on the support. To do so, a water jet nozzle bar can be arranged in the vicinity of a spinning beam, for example, said water jet nozzle bar performing a first preliminary compacting and fixing of the fibers, prior to a another fixing process, for example, a thermobonding process and/or a water jet compacting process.

Furthermore, the cup or other any other 3D shapes may be cut out of the manufactured compacted cloth by suitable measures, for example, by a punching operation or by laser cutting. Also, this may be following by another processing step, for example, printing, seaming, producing ready to wear items, etc.

Compacting of the fiber web by water jets is preferred. Additionally or alternatively, however, compacting may also be accomplished by means of other amorphous media such as, for example, gas jets, jets of an organic fluid, heat, glue or another adhesive agent or solvent. This applies to pre-compacting compacting of the fiber web on the support and also to a felt cloth or fleece fabric on the support, as well as to compacting following the removal of the not yet fully compacted felt cloth or fleece material from the support.

The introduced method enables the combination of different fiber materials in a three-dimensional felt body. For example, fibers of different materials may be successively deposited on the support. Layers of different fibers are thus formed in the fiber web, said fibers forming mutually bonded layers displaying different properties in the finished cloth or felt body. For example, structure-imparting solid fiber layers and fibers providing wearing comfort can be combined with each other.

Alternatively, it is possible to arrange a mixture of different fibers in the cloth or felt body in order to combine the properties of different fiber materials with each other.

It is also possible to use bicomponent fibers that, for example, have a core of a first material and a sheath of a second material. If brassiere cups are to be produced, it is desirable, as a rule, for said cups to display a certain elasticity. To accomplish this, the extruded fibers are produced in that the individual fiber will crimp and thus provide an elasticity effect. The crimped or uncrimped fiber may consist of an elastomer. A bicomponent fiber may be produced in that one component represents the strength component and is arranged in the center as the core, for example. An exterior component may sheath the core and determine the degree of softness of the fiber.

If a fiber multi-layer order is desired, for example, for the manufacture of brassiere cups and if the inside of the cup is located on the side facing the support, the soft fibers are deposited first by a first spinning beam, for example. The fibers providing the elastic support of the structure are applied in a second spinning beam. A third spinning beam may be disposed to apply the fibers that can be printed during a later process cycle, for example. If, in contrast, the support is arranged on the outside of the cup, the depositing sequence of the fibers is reversed.

The drawings illustrate exemplary embodiments of the invention.

DETAILED DESCRIPTION OF THE INVENTION

Figure 1:
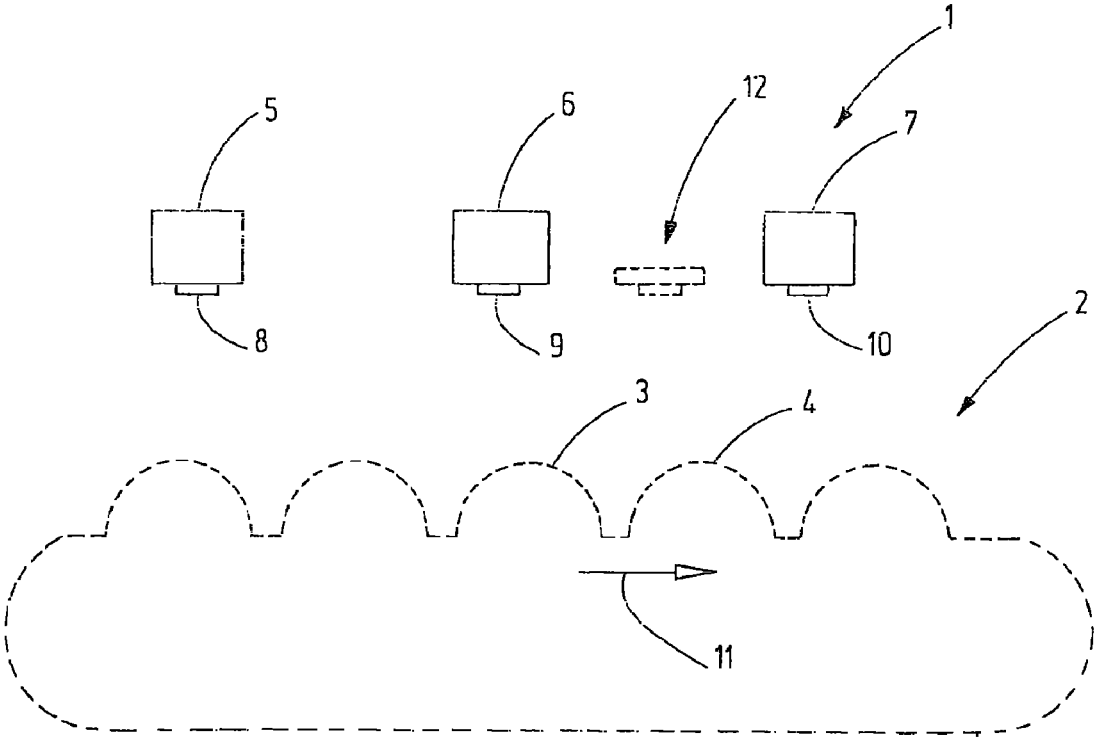
FIG. 1 is a schematized representation of a spinning beam and a three-dimensional support for the production of a three-dimensional fiber web.

FIG. 1 schematically illustrates a fiber depositing device 1, said device being used for the manufacture of spatially, i.e., three-dimensionally, shaped fleece materials. The fiber depositing device 1 comprises a support 2, said support comprising at least one, preferably, however, several 3D moulds 3, 4. These 3D molds 3, 4, for example, have the shape of a hemisphere or any other three-dimensional shapes. For example, the 3D molds 3, 4 may have a shape corresponding to the cup of a brassiere in order to manufacture brassieres. The 3D molds may be elevations or indentations. At least in parts, they have a surface that is curved at the same point in longitudinal direction of the support as well as in transverse direction of the support.

Preferably, the support 2 consists of a porous or sieve-like material. It may be a continuous belt, for example, looped around two or more rollers, said 3D molds 3, 4 being provided on said belt. To this extent, FIG. 1 only shows a detail of the support 2. The optionally driven rollers around which the support 2 is looped are not specifically shown.

The fiber depositing device 1 may further comprise one or more nozzle bars 5, 6, 7, each being provided with a series of melt-blow nozzles 8, 9, 10. These are disposed to extrude fibers of molten plastic material in order to apply said fibers to the support 2. While the nozzle bars 5, 6, 7 are preferably arranged so as to be stationary, the support 2 preferably designed as the continuous belt is preferably advanced in the longitudinal direction of the support, as illustrated by an arrow 11 in FIG. 1, in a direction transverse to the nozzle bar 5, 6, 7 under said nozzle bar.

Optionally, a fleece compacting arrangement 12, for example in the form of a nozzle strip, may be located at the end of the row formed by the nozzle bars 5, 6 or between adjacent nozzle bars 5, 6. This fleece compacting arrangement may be disposed to direct a water jet curtain at the support 2.

Alternatively, one or more of the melt-blow nozzles 8, 9, 10 can be replaced by arrangements that are disposed to apply prefabricated fibers, for example, natural fibers, on the support 2. Furthermore, the nozzle bars 5, 6, 7 may have the same or different designs. They may be disposed to apply fibers of the same or different synthetic materials to the support 2. Furthermore, one or more of the nozzle strips 5, 6, 7 may be disposed to produce fibers consisting of several components, for example, fibers having a core of a first material and a sheath of a second material.

Figure 2:
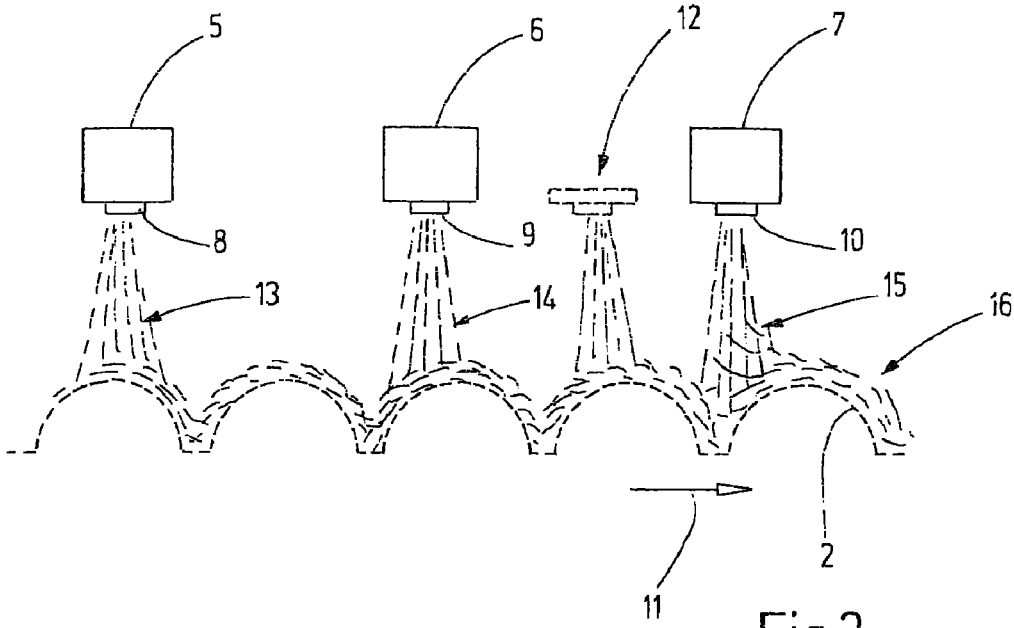
FIG. 2 is a schematized representation of the manufacture of the fiber web in the device in accordance with FIG. 1.

A three-dimensional fiber web as indicated in FIG. 2 can be produced with the fiber depositing device that is schematically shown in FIG. 1. The support 2 moving in the direction of arrow 11 passes under the nozzle bar 5, 6, 7. In doing so, first, the fibers 13 dispensed by the melt-blow nozzle 8, then the fibers 14 dispensed by the melt-blow nozzle 9, and then the fibers 15 dispensed by the melt-blow nozzle 10 impinge on the support 2 or on the fiber layer that has already been deposited. A fiber web 16 is formed on the approximately hemispherical 3D molds 3, 4. This fiber web may be completely loose. If a fleece compacting arrangement 12 is provided and operated, the fiber web 16 is at least partially compacted. The deposition of the fibers 13, 14, 15 on the support 2 may be promoted the stream of air coming from the melt-blow nozzles 8, 9, 10 as well as, optionally, by a vacuum that may be applied to the underside of the support 2. The fiber web 16 may consist of layers. For example, the fibers 13 may consist of a fleecy material that is well tolerated by the skin. For example, the fibers 14 may consist of a predominantly elastic, shaping and supporting material, while the fibers 15 may consist of the aforementioned materials or also of a third material, for example, a material intended for the exterior surface of a brassiere, said material being printable, dyed or being another material.

Figure 3:
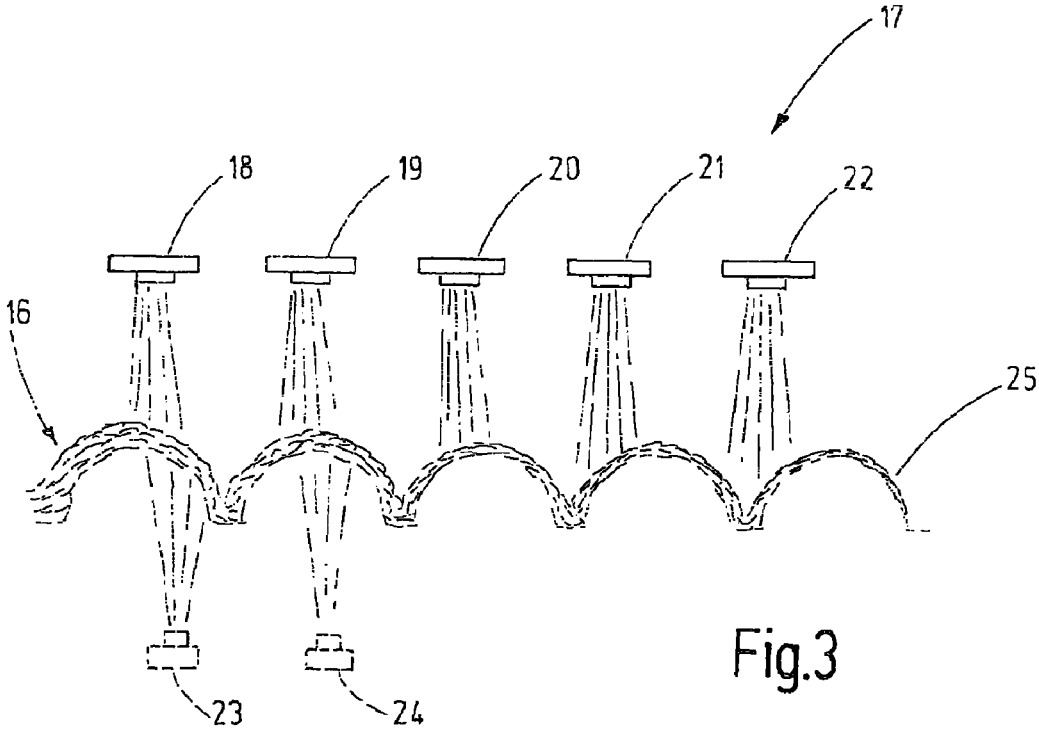
FIG. 3 is a schematized representation of the compacting of the fiber web.

The optionally pre-compacted fiber web is taken off one side of the continuously moving support 2 and fed to a compacting arrangement 17, as is obvious from FIG. 3. This compacting arrangement may comprise a row of nozzles 18 through 24, said nozzles, for example, directing fine water jets or jets of another gaseous or liquid fluid at the fiber web 16. The nozzles 18 through 24 may optionally be arranged only on one side of the fiber web 16 or also on both sides of said fiber web. FIG. 3 is a schematic illustration of the jets acting on the fiber web 16. Said jets are disposed to produce a compacted felt-like fleece or a fleece body 25 from the relatively loose fiber web 16 while maintaining the three-dimensional shape that has been originally prespecified by the support 2.

Figure 5:
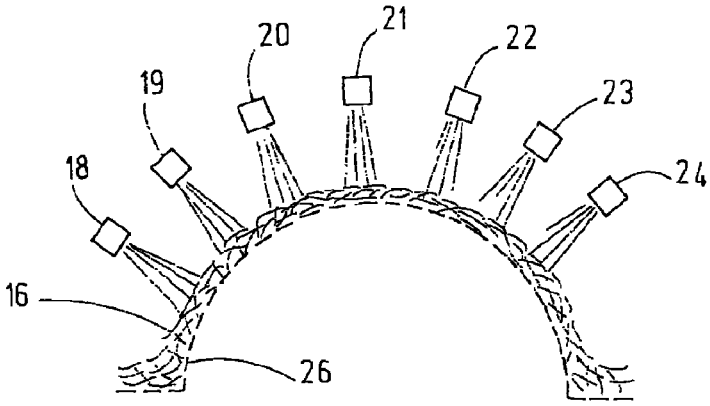
FIG. 5 is a schematized representation of an alternative option for compacting the fiber web.

In the present exemplary embodiment, the nozzles 18 through 24 are aligned parallel to each other. However, it is also possible to align the nozzles 23 through 24 so as to adapt to the spatial shape of the desired felt body. Furthermore, as is indicated in FIG. 5, it is possible to hold the fiber web 16 for compacting on a suitable sieve-like support 26, for example.

Figure 4:
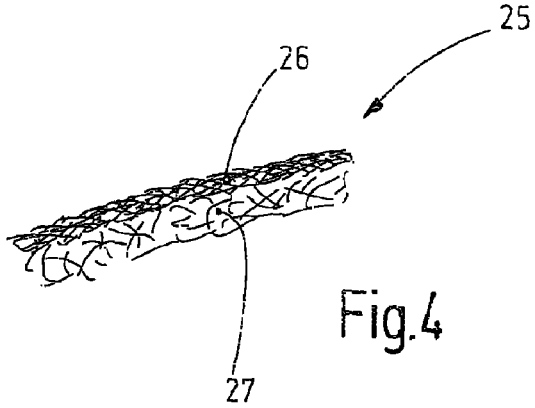
FIG. 4 is an enlarged detail of a produced spatially shaped fleece.

FIG. 4 shows a detail of a fleece body 25 obtained in this manner. As can be seen, the fleece body 25 consists of several layers, i.e., two layers in this case. Said fleece body consists of a first fiber layer 26, for example consisting of soft, crimped fibers, and of an exterior second fiber layer 27 consisting of fibers of another material. Both fiber layers 26, 27 are intimately connected with each other and are felted together or compacted. They follow the shape that has originally been prespecified by the support 2. The desired 3D felt bodies, for example, items of clothing, for example, brassiere blanks, can be cut out of the fleece body 25 manufactured in this manner. Said brassiere blanks may then be moved on to additional processing steps, wherein they are, for example, seamed, printed and/or made into ready to wear items.

Figure 6:
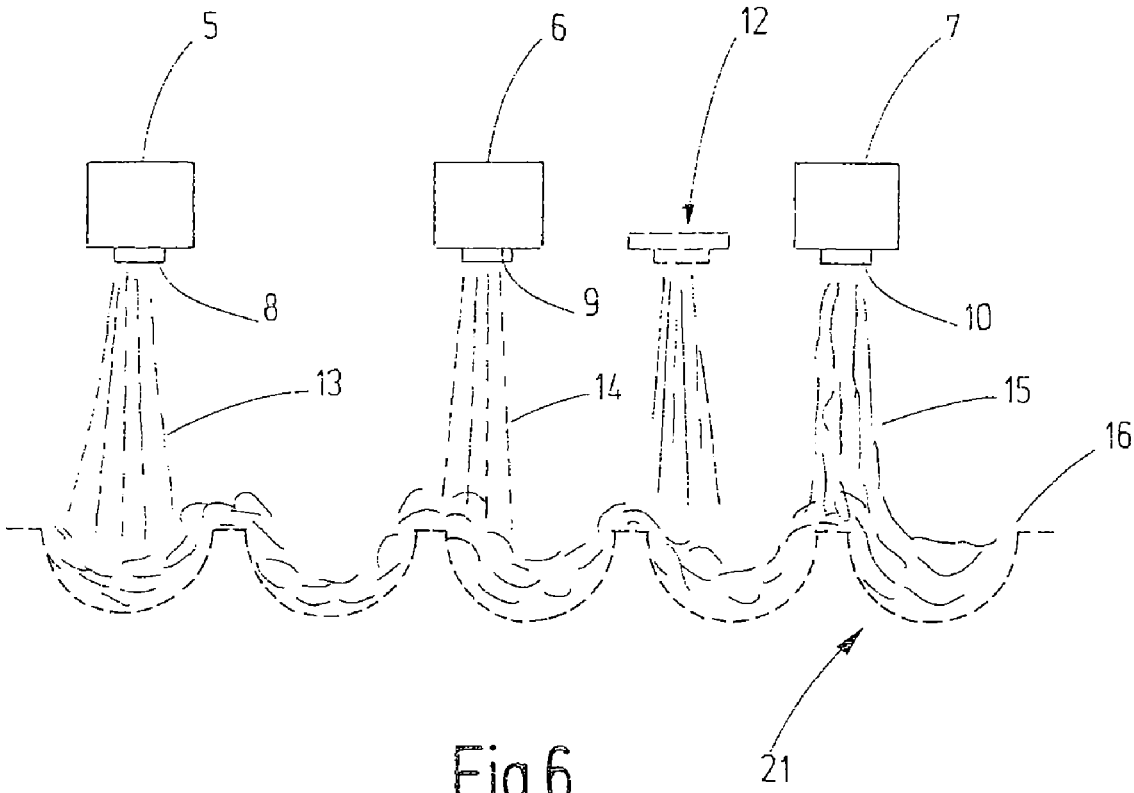
FIG. 6 shows the manufacture of a fiber web on a support corresponding to the desired exterior shape of a brassiere material.

Hereinabove, the method has been explained with reference to a support 2, said support defining the hollow shape, i.e., the interior of the felt body to be manufactured. However, as shown by FIG. 6, the support 2' can also be arranged in such a manner that it defines the convex exterior shape of the body to be produced. Again, one or more nozzle bars 5, 6, 7 having melt-blow nozzles 8, 9, 10 or other devices disposed for dispensing fibers are provided. The optional fleece compacting arrangement 12 is provided at a suitable point, for example between the nozzle bars 5, 6, 7, or also in a row formed at one end of the nozzle bars 5, 6, 7. In addition, it is possible to provide additional such fleece compacting devices between the other nozzle bars 5, 6. As previously described, the fibers 13, 14, 15 are applied to the support 2' and form a relatively loose, optionally pre-compacted, fiber web 16. Said fiber web may consist of a single material or, as preferred and shown in FIG. 6, consist of multiple layers. The pre-compacted fiber web may then again be moved to a compacting device 17, as has already been shown in FIG. 3.

Instead of the shown water jet compacting method or in addition to said method, it is also possible to perform other processing steps such as, for example, thermobonding, proofing or the like.

In the inventive method for the manufacture of spatial objects of a fleece or felt, the fibers are deposited on a mold that is preferably air-permeable. The fibers may be attracted to the mold by a vacuum applied to the underside of said mold. Preferably, the mold has several spatial structures that define the shape of the fiber web that is being formed and that correspond at least approximately to the desired final shape. By subsequent compacting of the thusly obtained fiber web, a spatially three-dimensional felt object is obtained. In this method, subsequent deforming steps are unnecessary or reduced to a minimum, so that the material to be produced does not experience any substantial distortion.

It will be appreciated that the above description of the present invention is susceptible to various modifications, changes and modifications, and the same are intended to be comprehended within the meaning and range of equivalents of the appended claims.

List of Reference Numerals

1 Fiber depositing device
2 Support
3, 4 3D molds
5, 6, 7 Nozzle bar
8, 9, 10 Melt-blow nozzles
11 Direction
12 Fleece compacting arrangement
13, 14, 15 Fibers
16 Fiber web, fiber fleece
17 Compacting arrangement
18-24 Nozzles
25 Fleece body
26, 27 Fiber layer

What is claimed is:

1. Method for the manufacture of spatial objects of felt, said method comprising:

providing a support with at least one 3D mold, applying a non-woven web to the 3D mold by non-ordered depositing of first fibers on said mold and second fibers onto at least a portion of the first fibers on said mold after deposition of the first fibers on said mold, the second fibers having material properties different from the first fibers, compacting of the non-woven web to produce a three-dimensional felt body through the action of a fluid acting in the form of one or more jets on the non-woven web.

2. Method for the manufacture of spatial objects of felt, said method comprising:

providing a support with at least one 3D mold, applying a non-woven web to the 3D mold by non-ordered depositing of fibers on said mold, compacting of the non-woven web to produce a three-dimensional felt body characterized in that, for compacting, the non-woven fleece is removed from the support and then compacted.

3. Method in accordance with claim 1, characterized in that, prior to being removed, the non-woven web is pre-compacted on the 3D mold.

4. Method in accordance with claim 3, characterized in that, for pre-compacting, a fluid, heat or an adhesive agent and/or solvent acting in the form of jets on the non-woven web is used.

5. Method in accordance with claim 1, characterized in that at least fibers of a first material and fibers of a second material are used for the manufacture of the non-woven fiber fleece.

6. Method in accordance with claim 1, characterized in that, after compacting the non-woven web, parts are cut out of the felt body.

7. Device for the manufacture spatial objects of felt, said device comprising:

a support with at least one 3D mold, a first fiber dispensing device configured to apply by non-ordered deposition first fibers on said mold, a second fiber dispensing device configured to apply by non-ordered deposition second fibers onto at least a portion of the first fibers on said mold after deposition of the first fibers on said mold to create a non-woven fiber fleece, the second fibers having material properties different from the first fibers, at least one nozzle configured to direct a jet of fluid on the non-woven fiber fleece to produce a three-dimensional felt body.

8. Device in accordance with claim 7, characterized in that at least one of the first fiber dispensing device or the second fiber dispensing device comprises at least one nozzle bar.

9. Device in accordance with claim 7, further comprising a pre-compacting arrangement located opposite the 3D mold.

10. Device in accordance with claim 9, characterized in that the pre-compacting arrangement comprises at least one nozzle bar configured to direct jets of a fluid against the non-woven fiber fleece.

* * * * *